US009260123B2

(12) United States Patent
Fanara et al.

(10) Patent No.: US 9,260,123 B2
(45) Date of Patent: Feb. 16, 2016

(54) SYSTEM AND METHOD FOR DETERMINING LOCOMOTIVE POSITION IN A CONSIST

(71) Applicant: Electro-Motive Diesel, Inc., La Grange, IL (US)

(72) Inventors: Mark Alan Fanara, Blue Springs, MO (US); Warren Douglas Burnett, Lee's Summit, MO (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 119 days.

(21) Appl. No.: 13/974,712

(22) Filed: Aug. 23, 2013

(65) Prior Publication Data

US 2015/0053110 A1 Feb. 26, 2015

(51) Int. Cl.
*B61L 15/00* (2006.01)
*B61L 25/02* (2006.01)

(52) U.S. Cl.
CPC ..... *B61L 25/028* (2013.01); *B61L 15/0036* (2013.01)

(58) Field of Classification Search
CPC ..... B61L 25/00; B61L 25/02; B61L 25/021; B61L 25/025; B61L 25/028; B61L 25/04
USPC ..... 246/2 R, 3, 4, 6, 7, 122 R, 124, 167 R
See application file for complete search history.

(56) References Cited

U.S. PATENT DOCUMENTS 3,093,802 A 6/1963 Chow
4,012,603 A 3/1977 Araseki et al.
4,383,243 A 5/1983 Kruegel et al.

(Continued)

FOREIGN PATENT DOCUMENTS

DE 421 4821 11/1992
DE 195 01 887 7/1995

(Continued)

OTHER PUBLICATIONS

Amirshahi, Pouyan, et al., "High-Frequency Characteristics of Overhead Multiconductor Power Lines for Broadband Communications," IEEE Journal on Selected Areas in Communications, vol. 24, No. 7, Jul. 2006, p. 1292.

(Continued)

*Primary Examiner* — R. J. McCarry, Jr.
(74) *Attorney, Agent, or Firm* — Finnegan, Henderson, Farabow, Garrett & Dunner, LLP

(57) ABSTRACT

A system for determining locomotive position in a consist including a first locomotive, a second locomotive, and one or more additional locomotives has a processor configured to determine first measurements taken starting from the first locomotive and capable of quantifying distances between the first locomotive and the second locomotive and the first locomotive and the one or more additional locomotives. The processor is also configured to determine second measurements taken starting from the second locomotive and capable of quantifying distances between the second locomotive and the first locomotive and the second locomotive and the one or more additional locomotives. The processor is further configured to combine the first measurements and the second measurements into a combined data set and, determine a locomotive consist order based on the combined data set.

20 Claims, 4 Drawing Sheets

(56) References Cited

U.S. PATENT DOCUMENTS

| | | | | |
|---|---|---|---|---|
| 4,556,866 | A | 12/1985 | Gorecki | |
| 4,578,818 | A | 3/1986 | Claydon | |
| 4,721,923 | A | 1/1988 | Bares et al. | |
| 4,723,963 | A | 2/1988 | Taylor, Jr. et al. | |
| 4,815,106 | A | 3/1989 | Propp et al. | |
| 4,860,308 | A | 8/1989 | Kamerman et al. | |
| 5,351,272 | A | 9/1994 | Abraham | |
| 5,446,918 | A | 8/1995 | Lamy | |
| 5,651,517 | A | 7/1997 | Stevens et al. | |
| 5,706,191 | A | 1/1998 | Bassett et al. | |
| 5,717,685 | A | 2/1998 | Abraham | |
| 5,777,545 | A | 7/1998 | Patel et al. | |
| 5,777,547 | A | 7/1998 | Waldrop | |
| 5,818,127 | A | 10/1998 | Abraham | |
| 5,969,643 | A * | 10/1999 | Curtis | 340/988 |
| 5,986,577 | A | 11/1999 | Bezos | |
| 6,114,974 | A | 9/2000 | Halvorson | |
| 6,163,089 | A * | 12/2000 | Kull | 307/151 |
| 6,311,045 | B1 | 10/2001 | Domokos | |
| 6,373,375 | B1 | 4/2002 | Hoetzel et al. | |
| 6,392,368 | B1 | 5/2002 | Deller et al. | |
| 6,392,562 | B1 | 5/2002 | Boston et al. | |
| 6,408,766 | B1 | 6/2002 | McLaughlin et al. | |
| 6,421,587 | B2 | 7/2002 | Diana et al. | |
| 6,442,195 | B1 | 8/2002 | Liu et al. | |
| 6,490,523 | B2 | 12/2002 | Doner | |
| 6,553,838 | B2 | 4/2003 | Amini | |
| 6,567,648 | B1 | 5/2003 | Ahn et al. | |
| 6,587,739 | B1 | 7/2003 | Abrams et al. | |
| 6,595,045 | B1 | 7/2003 | Fuglewicz et al. | |
| 6,972,670 | B2 | 12/2005 | LaDuc et al. | |
| 6,995,658 | B2 | 2/2006 | Tustison et al. | |
| 7,006,523 | B2 | 2/2006 | Binder | |
| 7,021,588 | B2 | 4/2006 | Hess, Jr. et al. | |
| 7,113,752 | B2 | 9/2006 | Leinonen et al. | |
| 7,182,411 | B2 | 2/2007 | Levy et al. | |
| 7,206,320 | B2 | 4/2007 | Iwamura | |
| 7,336,156 | B2 | 2/2008 | Arita et al. | |
| 7,499,682 | B2 | 3/2009 | Rozenblit et al. | |
| 7,634,240 | B2 | 12/2009 | Milzlaff et al. | |
| 7,893,557 | B2 | 2/2011 | Davis et al. | |
| 7,933,420 | B2 | 4/2011 | Copley et al. | |
| 8,036,402 | B2 | 10/2011 | Furge | |
| 8,068,616 | B2 | 11/2011 | Copley et al. | |
| 8,140,027 | B2 | 3/2012 | Ozgun et al. | |
| 8,160,520 | B2 | 4/2012 | Srinivasan et al. | |
| 8,232,666 | B2 | 7/2012 | Rocamora et al. | |
| 8,305,229 | B1 | 11/2012 | Gard | |
| 8,306,489 | B2 | 11/2012 | Schwarzmueller et al. | |
| 8,340,318 | B2 | 12/2012 | Copley et al. | |
| 8,364,189 | B2 | 1/2013 | Mintah et al. | |
| 8,447,255 | B2 | 5/2013 | Asokan | |
| 2001/0043450 | A1 * | 11/2001 | Seale et al. | 361/160 |
| 2002/0011923 | A1 | 1/2002 | Cunningham et al. | |
| 2002/0101882 | A1 | 8/2002 | Kim | |
| 2002/0167398 | A1 | 11/2002 | Strasser | |
| 2003/0195668 | A1 | 10/2003 | Radtke et al. | |
| 2004/0223275 | A1 | 11/2004 | Yanagida et al. | |
| 2004/0261101 | A1 | 12/2004 | Iwamura | |
| 2005/0013320 | A1 | 1/2005 | Binder | |
| 2005/0085259 | A1 | 4/2005 | Conner et al. | |
| 2005/0143868 | A1 | 6/2005 | Whelan | |
| 2006/0025903 | A1 | 2/2006 | Kumar | |
| 2006/0170285 | A1 | 8/2006 | Morimitsu et al. | |
| 2007/0136050 | A1 | 6/2007 | Tourwe | |
| 2007/0282494 | A1 | 12/2007 | Moffitt et al. | |
| 2007/0286079 | A1 | 12/2007 | Mollenkopf et al. | |
| 2008/0003962 | A1 | 1/2008 | Ngai | |
| 2008/0195259 | A1 | 8/2008 | Davis et al. | |
| 2008/0211663 | A1 | 9/2008 | Mansfield et al. | |
| 2008/0298384 | A1 | 12/2008 | Beaucage | |
| 2009/0042436 | A1 | 2/2009 | Emoto et al. | |
| 2009/0287496 | A1 | 11/2009 | Thyssen et al. | |
| 2010/0045447 | A1 | 2/2010 | Mollenkopf et al. | |
| 2010/0235022 | A1 | 9/2010 | Siddappa et al. | |
| 2010/0241295 | A1 | 9/2010 | Cooper et al. | |
| 2010/0256842 | A1 | 10/2010 | Liberatore | |
| 2011/0093144 | A1 | 4/2011 | Goodermuth et al. | |
| 2012/0095580 | A1 | 4/2012 | Zhang | |
| 2012/0163201 | A1 | 6/2012 | Williams et al. | |
| 2013/0038424 | A1 | 2/2013 | Katar et al. | |
| 2013/0077801 | A1 | 3/2013 | Tarnowski | |
| 2013/0271342 | A1 | 10/2013 | Shen | |
| 2013/0320154 | A1 | 12/2013 | Brown | |
| 2013/0323939 | A1 | 12/2013 | Brown | |

FOREIGN PATENT DOCUMENTS

| | | |
|---|---|---|
| DE | 100 44 088 | 4/2002 |
| DE | 202007008825 | 8/2007 |
| EP | 0 968 897 | 1/2000 |
| EP | 1 010 602 | 6/2000 |
| EP | 1 065 127 | 1/2001 |
| EP | 1 253 725 | 10/2002 |
| EP | 1 306 283 | 5/2003 |
| EP | 1 487 128 | 12/2004 |
| GB | 109 7125 | 12/1967 |
| GB | 2 450 520 | 12/2008 |
| JP | 7508609 | 9/1995 |
| JP | 11/317697 | 11/1999 |
| JP | 2004/235752 | 8/2004 |
| JP | 2004/241997 | 6/2005 |
| JP | 2005/176131 | 6/2005 |
| WO | WO 94/01949 | 1/1994 |
| WO | WO 2004/054224 | 6/2004 |
| WO | WO 2006/075767 A3 | 7/2006 |

OTHER PUBLICATIONS

Carcelle, Xavier, "Power Line Communications in Practice," Hybrid PLC (2009), p. 304.

Dai, Huaiyu, et al., "Advanced Signal Processing for Power Line Communications," *IEEE Communications Magazine*, May 2003, p. 100.

Hailes, S., "Modern telecommunications systems for train control," The 11th IET Professional Development Course on Railway Signalling and Control Systems, Jun. 2006, pp. 185-192.

IEEE Standard for Communications Protocol Aboard Trains, IEEE Std 1473-1999.

Kamata, Keiichi, "T-Ethernet: The Next International Standard Candidate for Train Communication Network." 2008.

Kirrmann, Hubert, et al., "The IEC/IEEE Train Communication Network," IEEE (2001).

Latchman, Haniph A., et al., "Homeplug AV and IEEE 1901: A Handbook for PLC Designers and Users," IEEE Press, p. 316.

Liu, Er, et al., "Broadband Powerline Channel and Capacity Analysis," IEEE (2005) p. 7.

Liu, Er, et al., "Powerline Communication Over Special Systems," IEEE (2005), p. 167.

"Nexans signaling cable enhances," *Railway Gazette International*; Apr. 2006; 162, 4; ProQuest, p. 206.

PM4380 Analog Front End for VDSL2/ADSL2+, Preliminary Product Brief, PMC-2060187, Issue 3, PMC-Sierra, Inc. (2007).

Roden, Andrew, "Duotrack signals S&T cabling revolution," *International Railway Journal*; Jul. 2007; 47, 7; ABI/INFORM Complete, p. 38.

Russo, D., et al., "A New Approach for Train Passenger Information Systems," presented at WCRR 2008 Seoul Korea, May 18-22, 2008.

Swanson, John D., "Advanced Light Rail Vehicle Communication Systems Design," Proceedings of the 2004 ASME/IEEE Joint Rail Conference, Apr. 6-8, 2004, p. 213.

Trainline communications—trainline communication system specifications—Vehicle Track Systems Newletter, *Railway Age*, Dec. 1994.

U.S. Appl. No. 14/250,613 by Neil Keith Habermehl et al., filed Apr. 11, 2014, entitled "Train Communication Network."

U.S. Appl. No. 14/250,586 by Neil Keith Habermehl et al., filed Apr. 11, 2014, entitled "Train Communication Network."

U.S. Appl. No. 14/250,641 by Neil Keith Habermehl et al., filed Apr. 11, 2014, entitled "Train Communication Network."

* cited by examiner

SYSTEM AND METHOD FOR DETERMINING LOCOMOTIVE POSITION IN A CONSIST

TECHNICAL FIELD

The present disclosure relates generally to a locomotive consist, and more particularly, to a system and method for determining locomotive position in a consist.

BACKGROUND

A consist includes one or more locomotives that are coupled together to produce motive power for a train of rail vehicles. The locomotives each include one or more engines, which combust fuel to produce mechanical power. The engine(s) of each locomotive can be supplied with liquid fuel (e.g., diesel fuel) from an onboard tank, gaseous fuel (e.g., natural gas) from a tender car, or a blend of the liquid and gaseous fuels. The mechanical power produced by the combustion process is directed through a generator and used to generate electricity. The electricity is then routed to traction motors of the locomotives, thereby generating torque that propels the train. The locomotives can be connected together at the front of the train or separated and located at different positions along the train. For example, the consist can be positioned at the front, middle, or end of the train. In some instances, more than one consist can be included within a single train. The locomotives in a consist can be oriented in a forward-facing (or "long hood") direction or a backward-facing (or "short hood") direction. In some consists, the locomotives include computer systems for maintaining operations of the locomotive. These computer systems are sometimes disposed on the long hood side of the locomotive.

Because the locomotives of a consist must cooperate to propel the train, communication between the locomotives can be important. Historically, this communication has been facilitated through the use of an MU (Multi-Unit) cable that extends along the length of the consist. An MU cable is comprised of many different wires, each capable of carrying a discrete signal used to regulate a different aspect of consist operation. For example, a lead locomotive generates current within a particular one of the wires to indicate a power level setting requested by the train operator. When this wire is energized, the engines of all trail locomotives are caused to operate at a specific throttle value. In another example, when one locomotive experiences a fault condition, another of the wires is energized to alert the other locomotives of the condition's existence.

In some consists, locomotives communicate via their respective computer systems on an Ethernet network formed over the MU cables. With this configuration, network data can be transmitted from the computer system in the lead locomotive to the computer systems in the trail locomotives, and vice-versa. The network data includes data that is packaged as data packets and uniquely addressed to particular computer systems, or portions of the computer systems. The network data can be, for example, vehicle sensor data indicative of vehicle health, commodity condition data, temperature data, weight data, and security data. The network data is transmitted orthogonal to conventional non-network (i.e., command) data that is already being transmitted on the MU cable.

For some operations, the order of locomotives within the consist can be important. For example, each locomotive within the consist may set their throttles according to their respective positions within the consist. Traditionally, locomotive consist order is determined and set manually by a human operator, but this method can be prone to error as locomotives are sometimes moved from one consist to another and the human operator may forget or neglect to reset a locomotive's position within the consist. One method of determining locomotive consist order using a computer is described in U.S. Pat. No. 5,986,577 (the '577 patent) issued to Bezos on Nov. 16, 1999. The '577 patent describes a system and method for determining the position of each railroad vehicle within a train consist. Each vehicle in the consist has a vehicle computing device. A computer on a locomotive sequentially commands each vehicle computing device. When a command is sent to a vehicle computing device, all of the other vehicle computing devices located between the locomotive and the commanded vehicle computing device sense an electrical signal carrying the command and respond to the computer on the locomotive. The computer, after having commanded all of the vehicle computing devices and having received the responses, automatically determines the position of each railroad vehicle relative to all other railroad vehicles within the train consist.

Although the system of the '577 patent attempts to determine locomotive consist order, the system is prone to error. For example, the system of the '577 patent determines locomotive consist order with respect to one locomotive in the consist and with one data set collected by that one locomotive, causing the system to be susceptible to errors. For example, when a consist has adjacent locomotives coupled long hood to long hood, the system of the '577 patent may determine they are in the same consist position because the distance between the computers of the adjacent locomotives is close, causing data from either of the adjacent locomotives to appear to have originated from the other. Further, the system of the '577 patent can be prone to error because response time of the individual vehicle computing devices can vary, causing inconsistent or inaccurate results.

The disclosed system is directed to overcoming one or more of the problems set forth above.

SUMMARY

In one aspect, the present disclosure is directed to a system for determining locomotive position in a consist including a first locomotive, a second locomotive, and one or more additional locomotives. The system includes a processor configured to determine first measurements taken starting from the first locomotive and capable of quantifying distances between the first locomotive and the second locomotive and the first locomotive and the one or more additional locomotives. The processor is also configured to determine second measurements taken starting from the second locomotive and capable of quantifying distances between the second locomotive and the first locomotive and the second locomotive and the one or more additional locomotives. The processor is further configured to combine the first measurements and the second measurements into a combined data set and determine a locomotive consist order based on the combined data set.

In another aspect, the present disclosure is directed to a method for determining locomotive position in a consist including determining first measurements taken starting from a first locomotive of a consist quantifying distances between the first locomotive and a second locomotive of the consist and the first locomotive and one or more additional locomotives of the consist. The method determines second measurements taken starting from the second locomotive quantifying distances between the second locomotive and the first locomotive and the second locomotive and the one or more additional locomotives. The method combines the first measurements and the second measurements into a combined data set and determines a locomotive consist order based on the combined data set.

DETAILED DESCRIPTION

Figure 1:
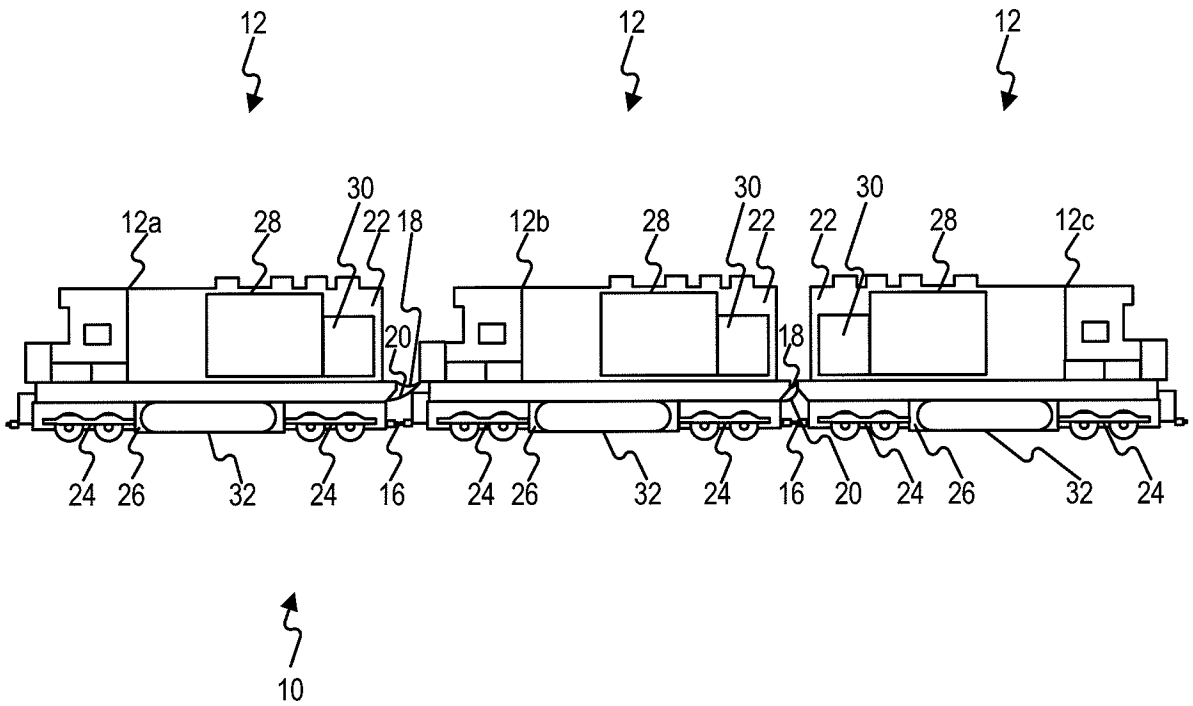
FIG. 1 is a pictorial illustration of an exemplary disclosed consist.

FIG. 1 illustrates an exemplary train consist 10 having one or more locomotives 12. In the disclosed embodiment, consist 10 has three different locomotives 12, including a lead locomotive 12*a* and two trailing locomotives 12*b*, 12*c*. It is contemplated, however, that consist 10 can include any number of locomotives 12 and other cars (e.g. tender cars), and that locomotives 12 can be located in any arrangement and in any orientation (e.g., forward-facing or rear-facing). Consist 10 can be located at the front of a train of other rail vehicles (not shown), within the train of rail vehicles, or at the end of the train of rail vehicles. It is also contemplated that more than one consist 10 can be included within a single train of rail vehicles, if desired, and/or that consist 10 can travel at times without a train of other rail vehicles.

Each locomotive 12 can be connected to an adjacent locomotive 12 in several different ways. For example, locomotives 12 can be connected to each other via a mechanical coupling 16, one or more fluid couplings 18, and one or more electrical couplings 20. Mechanical coupling 16 can be configured to transmit tractive and braking forces between locomotives 12. Fluid couplings 18 may be configured to transmit fluids (e.g., fuel, coolant, lubrication, pressurized air, etc.) between locomotives 12. Electrical couplings 20 can be configured to transmit power and/or data (e.g., data in the form of electrical signals) between locomotives 12. In one example, electrical couplings 20 include an intra-consist electrical cable, such as a MU cable, configured to transmit conventional command signals and/or electrical power. In another example, electrical couplings 20 include a dedicated data link configured to transmit packets of data (e.g., Ethernet data). In yet another example, the data packets can be transmitted via the intra-consist electrical cable. It is also contemplated that some data can be transmitted between locomotives 12 via a combination of the intra-consist electrical cable, the dedicated data link, and/or other means (e.g., wirelessly), if desired.

Each locomotive 12 can include a car body 22 supported at opposing ends by a plurality of trucks 24 (e.g., two trucks 24). Each truck 24 can be configured to engage a track (not shown) via a plurality of wheels, and to support a frame 26 of car body 22. Any number of engines 28 can be mounted to frame 26 within car body 22 and drivingly connected to a generator 30 to produce electricity that propels the wheels of each truck 24. Engines 28 can be internal combustion engines configured to combust a mixture of air and fuel. The fuel can include a liquid fuel (e.g., diesel) provided to engines 28 from a tank 32 located onboard each locomotive 12 or via fluid couplings 18, and/or a blended mixture of the liquid and gaseous fuels.

Figure 2:
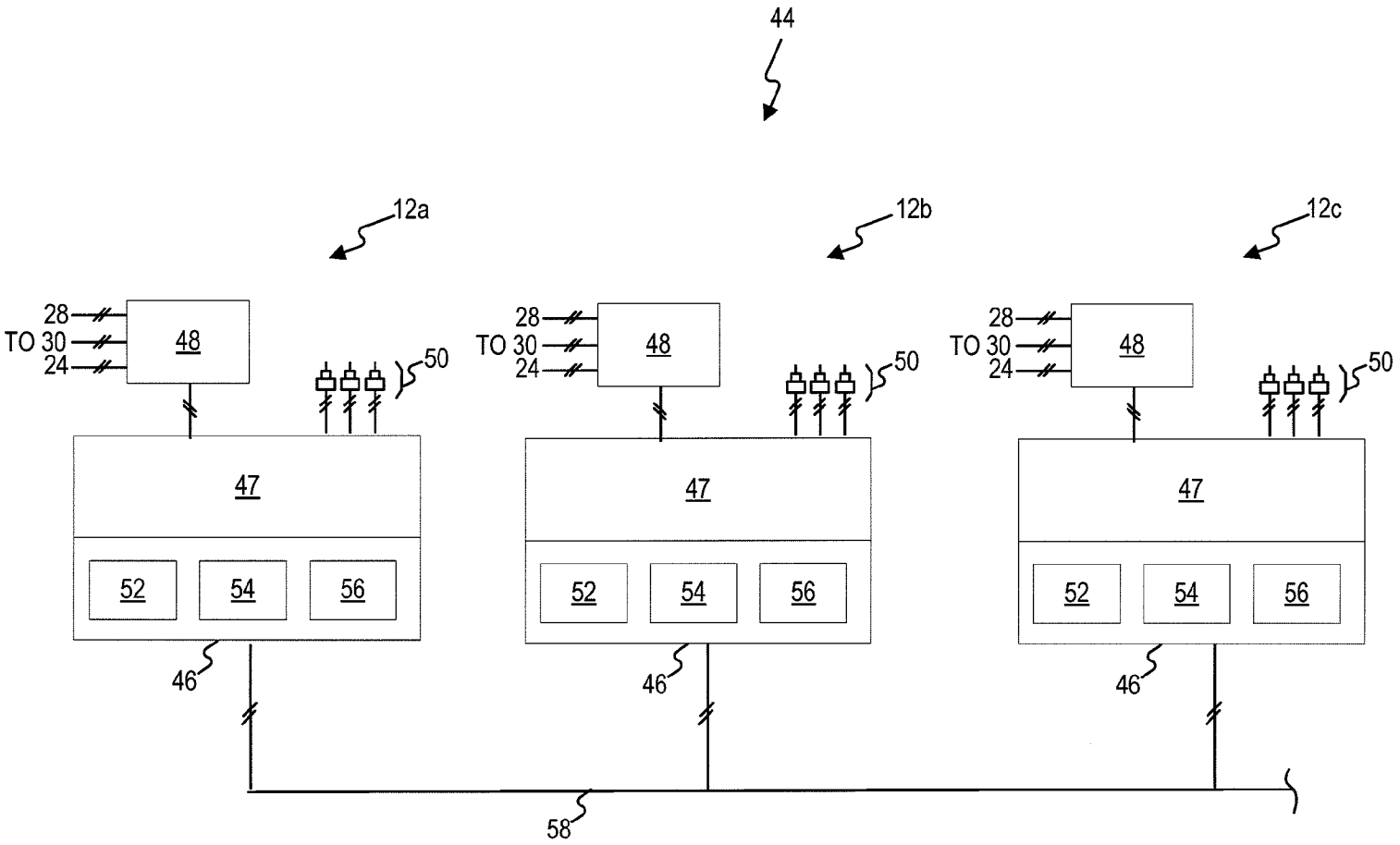
FIG. 2 is a diagrammatic illustration of an exemplary disclosed communication system that may be used in conjunction with the consist of FIG. 1.

As shown in FIG. 2, consist 10 can be equipped with a communication system 44 that facilitates coordinated control of locomotives 12. Communication system 44 can include, among other things, an access point 46 for each locomotive 12. Each access point 46 can be connected to one or more wired and/or wireless networks, and used to communicate command signals and/or data between controllers 48 of each rail vehicle and various other network components 50 (e.g., sensor, valves, pumps, heat exchangers, accumulators, regulators, actuators, GPS components, etc.) that are used to control locomotives 12. Access points 46 can be connected to each other via electrical couplings 20 (e.g., via the intra-consist electrical cable, via the dedicated data link, and/or wirelessly). Access points 46 can be connected to a local area network hub ("LAN hub") 47 that facilitates communication between the controllers 48, the network components 50, and access points 46.

Each access point 46 can include an inter-consist router ("IC router") 52, an Ethernet bridge 54, and an MU modem 56, as well as conventional computing components known in the art (not shown) such as a processor, input/output (I/O) ports, a storage, a memory. The I/O ports may facilitate communication between the associated access point 46 and the LAN hub 47. In some embodiments, the I/O ports may facilitate communication between the associated access point 46 and one or more of network components 50.

Likewise, IC router 52 can facilitate communication between different access points 46 of locomotives 12 that are connected to each other via electrical couplings 20. In some embodiments, IC router 52 can provide a proxy IP address corresponding to controllers 48 and network components 50 of remote locomotives. For example, IC router 52 can provide a proxy IP address for one of network components 50 of locomotive 12*b* so controller 48 of locomotive 12*a* can communicate with it. The IC router 52 can include, or be connected to, an Ethernet bridge 54 that can be configured to translate network data to an electrical signal capable of being sent through intra-consist electrical cable 58. Ethernet bridge 54 can include or be connected to MU modem 56. MU modem 56 can be configured to modulate a carrier signal sent over intra-consist electrical cable 58 with the electrical signal received from Ethernet bridge 54 to transmit network data between access points 46. MU modem 56 can also be configured to demodulate signals received from access points 46 and send the demodulated signals to Ethernet bridge 54 for conversion to network data destined to controller 48 or network components 50. In some embodiments, MU modem 56 sends network data orthogonal to data traditionally transmitted over intra-consist electrical cable 58 (e.g., control data). Although FIG. 2 illustrates IC router 52, Ethernet bridge 54, and MU modem 56 as separate components, in some embodiments, one component can perform the functionality of two components. For example, Ethernet bridge 54 may perform the operations described above with respect to IC router 52, or Ethernet bridge 54 can include, or perform the operations of, MU modem 56.

In some embodiments, access point 46, IC router 52, Ethernet bridge 54, and/or MU modem 56 can include a processor, storage, and/or memory (not shown). The processor can include one or more processing devices, such as microprocessors and/or embedded controllers. The storage can include volatile or non-volatile, magnetic, semiconductor, tape, optical, removable, non-removable, or other type of computer-readable medium or computer-readable storage device. The storage can be configured to store programs and/or other information that can be used to implement one or more of the processes discussed below. The memory can include one or more storage devices configured to store information.

Each controller 48 can be configured to control operational aspects of its related rail vehicle. For example, controller 48 of lead locomotive 12*a* can be configured to control operational aspects of its corresponding engine 28, generator 30, traction motors, operator displays, and other associated components. Likewise, the controllers 48 of trail locomotives 12*b* and 12*c* can be configured to control operational aspects of their corresponding engines 28, generators 30, traction motors, operator displays, and other associated components. In some embodiments, controller 48 of lead locomotive can be further configured to control operational aspects of trail locomotives 12*b* and 12*c*, if desired. For example, controller 48 of lead locomotive 12*a* can send commands through its access point 46 to the access points of trail locomotives 12*b* and 12*c*.

Each controller 48 can embody a single microprocessor or multiple microprocessors that include a means for controlling an operation of the associated rail vehicle based on information obtained from any number of network components 50 and/or communications received via access points 46. Numerous commercially available microprocessors can be configured to perform the functions of controller 48. Controller 48 can include a memory, a secondary storage device, a processor, and any other components for running an application. Various other circuits may be associated with controller 48 such as power supply circuitry, signal conditioning circuitry, solenoid driver circuitry, and other types of circuitry.

The information obtained by a particular controller 48 via access points 46 and/or network components 50 can include performance related data associated with operations of each locomotive 12 ("operational information"). For example, the operational information can include engine related parameters (e.g., speeds, temperatures, pressures, flow rates, etc.), generator related parameters (e.g., speeds, temperatures, voltages, currents, etc.), operator related parameters (e.g., desired speeds, desired fuel settings, locations, destinations, braking, etc.), liquid fuel related parameters (e.g., temperatures, consumption rates, fuel levels, demand, etc.), gaseous fuel related parameters (e.g., temperatures, supply rates, fuel levels, etc.), and other parameters known in the art.

The information obtained by a particular controller 48 via access points 46 and/or network components 50 can also include identification data of the other rail vehicles within the same consist 10. For example, each controller 48 can include stored in its memory the identification of the particular rail vehicle with which controller 48 is associated. The identification data can include, among other things, a type of rail vehicle (e.g., make, model, and unique identification number), physical attributes of the associated rail vehicle (e.g., size, load limit, volume, power output, power requirements, fuel consumption capacity, fuel supply capacity, etc.), and maintenance information (e.g., maintenance history, time until next scheduled maintenance, usage history, etc.). When coupled with other rail vehicles within a particular consist 10, each controller 48 can be configured to communicate the identification data to the other controllers 48 within the same consist 10. Each controller 48, can be configured to selectively affect operation of its own rail vehicle based on the obtained identification data associated with the other rail vehicles of consist 10.

In some embodiments, controllers 48 can be configured to affect operation of their associated rail vehicles based on the information obtained via access points 46 and/or network components 50 and one or more maps stored in memory. Each of these maps may include a collection of data in the form of tables, graphs, and/or equations. Controllers 48 can be configured to affect operation of their associated locomotives based on the position within a locomotive consist. The position of the locomotive associated with controller 48 can be used with the one or more maps to control the operation of the locomotive. For example, a map of throttle settings can be stored in the memory of controller 48. The map of throttle settings can include a mapping of consist position to throttle setting. For example, when the locomotive of controller 48 is the lead locomotive (e.g., in first position in the consist) the map may indicate that controller 48 should set the throttle to Notch 4, and when the locomotive of controller 48 is the third trail locomotive (e.g., in fourth position in the consist), the map may indicate that controller 48 should set the throttle to Notch 2.

According to some embodiments, one or more components of locomotive 12 can determine locomotive consist position, as described in further detail below with respect to FIG. 3. In some embodiments, controller 48 can be configured to execute instructions to determine locomotive consist position, and in some embodiments, IC router 52 or Ethernet bridge 54 can be configured to determine locomotive consist position. In some aspects, one of network components 50 can include a dedicated computing device including a processor, memory, and storage that has been configured to determine locomotive consist position.

Industrial Applicability

The disclosed system for determining locomotive position in a consist may be applicable to any consist that includes a plurality of rail cars, such as locomotives. The disclosed system for determining locomotive position may provide greater accuracy than conventional systems because it utilizes measurements collected from multiple locomotives within the consist. The operation of the system of determining locomotive position in a consist will now be explained.

Figure 3:
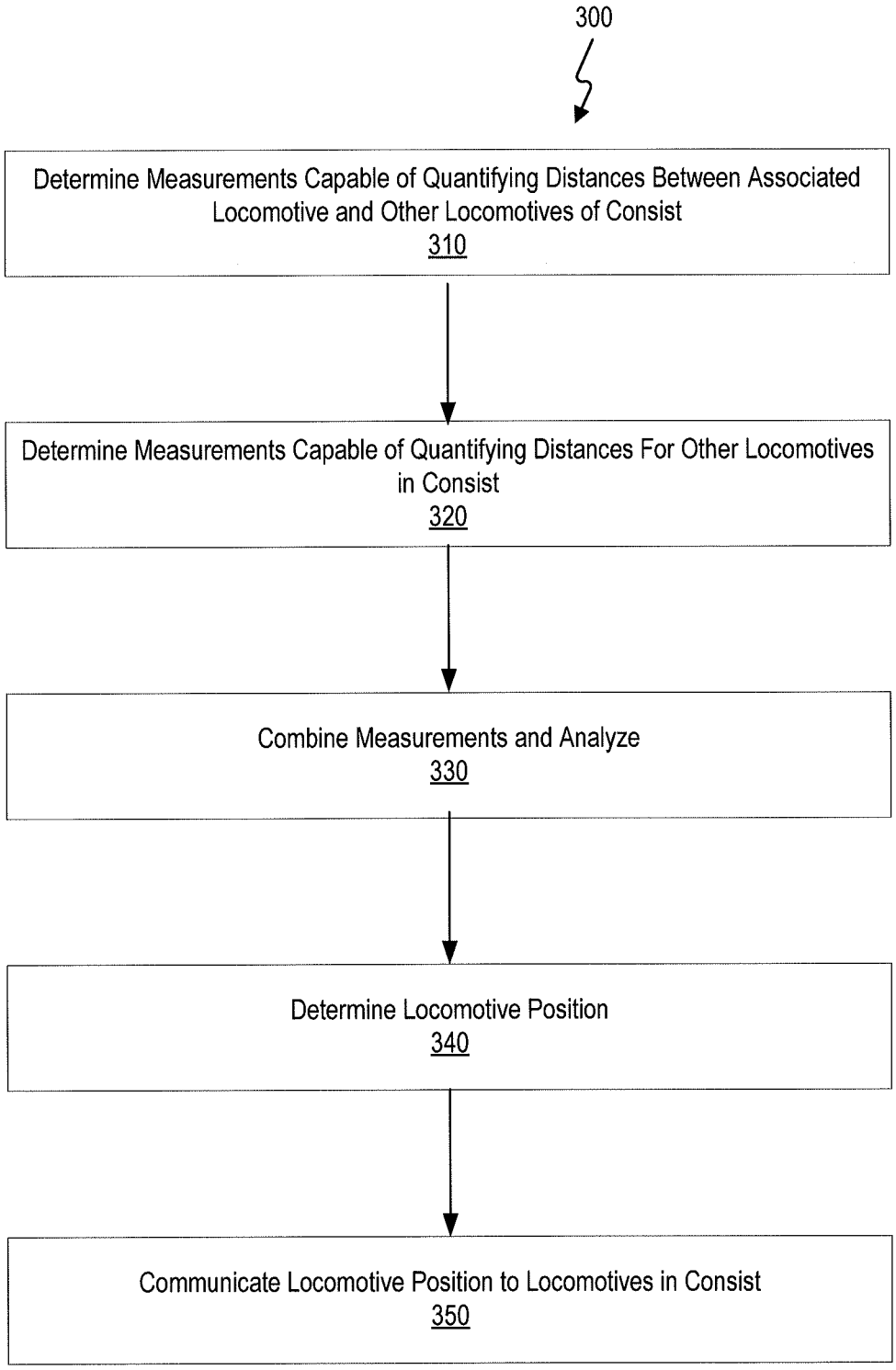
FIG. 3 is a flow chart illustrating an exemplary disclosed method for determining locomotive consist position that can be performed by one or more components of the communication system of FIG. 2; and, FIG. 4 is a pictorial illustration of an algorithm that can be performed by the method of FIG. 3.

FIG. 3 is a flowchart illustrating a method 300 that can be performed by one or more components of locomotive 12. During the operation of consist 10, controller 48, IC router 52, Ethernet bridge 54 or one of network components 50 can perform method 300 to determine the position of locomotives within a consist. Although any one of controller 48, IC router 52, Ethernet bridge 54 or one of network components 50 can perform method 300, for ease of discussion, method 300 will be described as being performed by controller 48.

Controller 48 begins method 300 by determining measurements capable of quantifying distances between its associated locomotive and the other locomotives of the consist (step 510). The determined measurements can include actual distances (e.g., 10 meters) or they can include measurements that can be converted to distances using one or more formulas derived from empirical observation of communication system 44. In some aspects, the determined measurements can include a data transmission measurement, such as a ping measurement. For example, controller 48 can start a timer, send a request to each access point 46 of communication system 44 to send a reply message, and stop the timer when the reply is received. Controller 48 can use a time-distance equation to determine the distance from controller 48 to each access point 46 of the consist. For example, the time-distance equation can specify that each 0.1 second of data transmission time correlates to 10 meters. When a controller 48 calculates a data transmission measurement of 0.65 seconds, it can determine that the access point associated with the data transmission measurement is 65 meters from it. The determined measurements can include, in some embodiments, signal strength measurements. For example, controller 48 can detect the signal strength of a signal received on intra-consist electrical cable and correlate the measured signal strength to a distance measurement. As data traveling over intra-consist electrical cables may slow due to increased distance, the determined measurements can also include a data rate measurements, such as bits per second. Once the controller determines the measurements, it can convert them to distances and store the distances in memory.

Next, controller 48 determines measurements capable of quantifying distances for other locomotives in the consist (step 320). In some embodiments, controller 48 determines the measurements for other locomotives in the consist by receiving them from a controller associated with each of the other locomotives in the consist. For example, when controller 48 is associated with a lead locomotive (e.g., locomotive 12*a*), it can receive a set of measurements from controllers associated with each trail locomotive in the consist (e.g., locomotive 12*b*, locomotive 12*c*). The controllers associated with other locomotives of the consist can collect measurements capable of quantifying distances in a manner described above with respect to step 310. For example, in a consist where controller 48 is associated with the lead locomotive, each trail locomotive may also have a controller associated with it. Each controller of the trail locomotives may perform the operations of step 310 to collect measurement data using its associated trail locomotive as a point of reference. For example, a controller associated with a first trail locomotive (e.g., locomotive 12*b*) of a consist can collect measurement data taken staring from a first trail locomotive to the other locomotives in the consist, such as the lead locomotive of the consist (e.g., locomotive 12*a*) and a second trail locomotive of the consist (e.g., locomotive 12*c*). The second locomotive of the consist can collect measurement data taken starting from the second trail locomotive of the consist to the other locomotives of the consist. Once the measurement data is collected, the controllers associated with the other locomotives of the consist send the measurement data to controller 48. The measurements can be sent to access point 46 of the lead locomotive as modulated data over intra-consist electrical cable 58. MU modem 56 can demodulate the modulated data, and Ethernet bridge 54 can convert the demodulated data to network packet data that is then sent to controller 48 via IC router 52 and LAN hub 47.

The measurements received by controller 48 from other controllers in the consist can be any format capable of quantifying distances. For example, as described above, the measurements received by controller can include data transmission measurements, signal strength measurements, or data rate measurements. Once controller 48 receives the measurements, it can calculate distances using one or more formulas derived from empirical observation of communication system 44. In some embodiments, controller 48 receives measurements that are distance measurements. For example, the other controllers of the consist can collect data transmission measurements, signal strength measurements, or data rate measurements and calculate distances before sending the measurements to controller 48. In such an embodiment, controller 48 will receive distance measurements and may not need to calculate distances.

Once controller 48 determines distance measurements taken starting from its associated locomotive, and determines distance measurements taken starting from the other locomotives of the consist, it can combine and analyze all the distance measurements (step 330). According to one embodiment, controller 48 combines its distance measurements with the distance measurements for the other locomotives of the consist into a combined data set that includes all of the distance measurements. Controller 48 can perform preliminary analysis on the combined data set. For example, controller 48 can sort the combined data set in ascending order for later processing. Controller 48 can also perform error analysis on the data set to remove measurements that deviate too far from other similar measurements. For example, controller 48 can determine that the distance between a first locomotive (e.g. locomotive 12*a*) and a second locomotive (e.g., locomotive 12*b*) is 200 feet, and the distance between the first locomotive and a third locomotive (e.g., locomotive 12*c*) is 400 feet. Controller 48 receives a measurement from a controller associated with the second locomotive indicating that the distance between the second locomotive and the first locomotive is 700 feet, and receives a measurement from the controller associated with the third locomotive that the distance between the third locomotive and first locomotive is 390 feet. As the measurement from the second locomotive's controller is inconsistent with the measurements obtained from the third locomotive's controller and controller 48, controller 48 can disregard the measurement received from the second locomotive's controller from further analysis.

After the measurements are combined and analyzed (at step 330), controller 48 can determine locomotive position based on the measurements in the combined data set (step 340). In some embodiments, controller 48 uses graph theory to determine locomotive position within the consist. For example, controller 48 can treat the locomotives as vertices of an undirected graph and treat the measurements of the combined data set as edge weights between the vertices in the undirected graph. Controller 48 can apply Prim's Algorithm to the undirected graph to determine a minimum spanning tree for the graph. The minimum spanning tree can specify the order of the locomotives within the consist.

Figure 4:
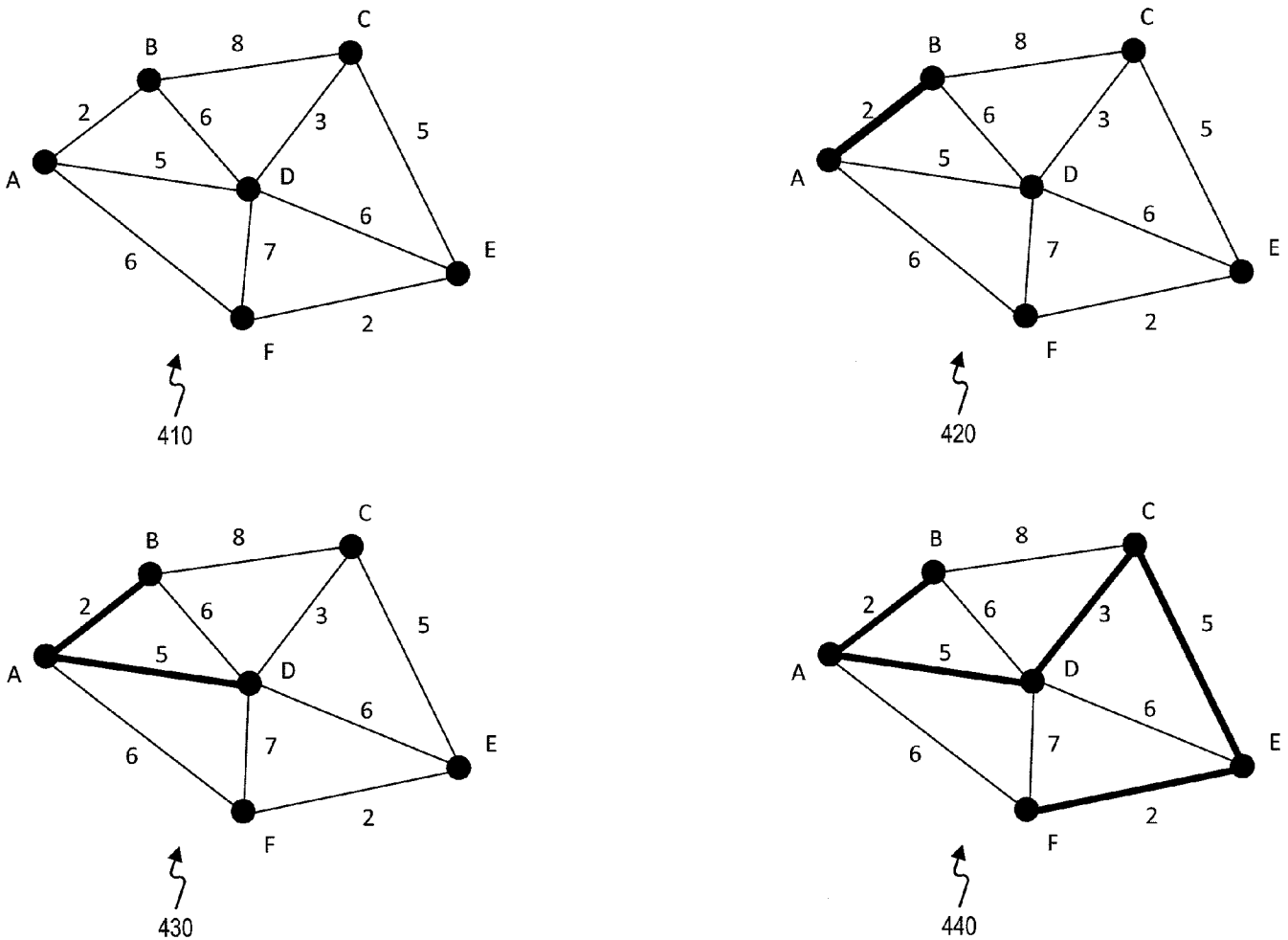

FIG. 4 shows a general application of Prim's Algorithm to an undirected graph 410. As known in the art, Prim's Algorithm starts with the selection of one vertex of the undirected graph, vertex A, for example. The selected vertex (in this case A) is the first vertex of the minimum spanning tree. The edges connected to A are analyzed to determine the edge with the lowest weight value, in this case, the edge from A to B (edge AB). Edge AB is added to the minimum spanning tree, as shown in undirected graph 420. Next, the edges connected to each vertex of the minimum spanning tree (A and B), are analyzed to determine the edge with the lowest weight value, in this case, the edge from A to D (edge AD). Edge AD is added to the minimum spanning tree, as shown in undirected graph 430. The algorithm repeats, adding the edges connected to the vertices of the minimum spanning tree with the lowest weight until all vertices are included in the minimum spanning tree. Undirected graph 440 illustrates the minimum spanning tree (in bold) of undirected graph 410. The minimum spanning tree specifies a vertex order. For example, the vertex order for the minimum spanning tree of undirected graph 440 is B-A-D-C-E-F or F-E-C-D-A-B.

Controller 48 can apply Prim's Algorithm to the combined data set similarly to arrive at a minimum spanning tree that specifies the order of locomotives in a consist. The following non-limiting example illustrates an example of controller 48 applying Prim's Algorithm to determine locomotive consist order. Controller 48 can be associated with a lead locomotive, Lead, in a five locomotive consist. The five locomotive consist further includes four trail locomotives, Trail 1, Trail 2, Trail 3, and Trail 4. Each of the trail locomotives is associated with its own controller capable of determining distances between itself and the other controllers (i.e., the other locomotives) of the consist. Consistent with the discussion above for step 310, the controller for Lead calculates the following distances between Lead and the other locomotives of the consist:

| From | To | Distance |
|---|---|---|
| Lead | Trail 1 | 148 |
| Lead | Trail 2 | 258 |
| Lead | Trail 3 | 330 |
| Lead | Trail 4 | 478 |

Each of the controllers for the trail locomotives also calculates distances between itself and the other controllers of the locomotives on the consist. The trail locomotives calculate the following measurements:

| From | To | Distance |
|---|---|---|
| Trail 1 | Lead | 157 |
| Trail 1 | Trail 2 | 110 |
| Trail 1 | Trail 3 | 182 |
| Trail 1 | Trail 4 | 330 |
| Trail 2 | Trail 1 | 105 |
| Trail 2 | Lead | 267 |
| Trail 2 | Trail 3 | 72 |
| Trail 2 | Trail 4 | 220 |
| Trail 3 | Trail 1 | 180 |
| Trail 3 | Trail 2 | 75 |
| Trail 3 | Lead | 330 |
| Trail 3 | Trail 4 | 148 |
| Trail 4 | Trail 1 | 325 |
| Trail 4 | Trail 2 | 258 |
| Trail 4 | Trail 3 | 150 |
| Trail 4 | Lead | 478 |

Each of the controllers for the trail locomotives sends the distance measurements it determines for its locomotive to the controller for the lead locomotive. The lead locomotive combines the measurements determined by the controllers for the trail locomotives into a combined data set. The combined data set is then sorted to produce the following sorted, combined data set:

| From | To | Distance |
|---|---|---|
| Trail 2 | Trail 3 | 72 |
| Trail 3 | Trail 2 | 75 |
| Trail 2 | Trail 1 | 105 |
| Trail 1 | Trail 2 | 110 |
| Lead | Trail 1 | 148 |
| Trail 3 | Trail 4 | 148 |
| Trail 4 | Trail 3 | 150 |
| Trail 1 | Lead | 157 |
| Trail 3 | Trail 1 | 180 |
| Trail 1 | Trail 3 | 182 |
| Trail 2 | Trail 4 | 220 |
| Lead | Trail 2 | 258 |
| Trail 4 | Trail 2 | 258 |
| Trail 2 | Lead | 267 |
| Trail 4 | Trail 1 | 325 |
| Lead | Trail 3 | 330 |
| Trail 1 | Trail 4 | 330 |
| Trail 3 | Lead | 330 |
| Lead | Trail 4 | 478 |
| Trail 4 | Lead | 478 |

The controller of the lead locomotive then applies Prim's Algorithm to the above data resulting in the following sequence of trees:

Trail 2—Trail 3

Trail 1—Trail 2—Trail 3

Lead—Trail 1—Trail 2—Trail 3

Lead—Trail 1—Trail 2—Trail 3—Trail 4

The final tree, Lead—Trail 1—Trail 2—Trail 3—Trail 4, is the minimum spanning tree and describes the order of the locomotives in the consist.

As the minimum spanning tree is undirected, either end of the minimum spanning tree could be the front of the consist. For example, either Lead or Trail 4 could be the front of the consist. Accordingly, in some embodiments, controller 48 can be configured to designate its associated locomotive as the lead locomotive. Controller 48 can be configured, for example, through a configuration file accessible by controller 48 or through a command issued to controller 48. The command can be generated in response to a received message from a computer system or from a human operator. For example, a human operator can press a button, or enter a code, into an input device connected to controller 48 that commands controller 48 to designate its associated locomotive as the lead locomotive. Controller 48 can, in some embodiments, send a message to the other controllers of the consist communicating that controller 48 is associated with the lead locomotive of the consist. Controllers within the locomotive consist can use the designation of the lead locomotive to determine the order of the minimum spanning tree as determined in step 330. The controller for Lead sends a message to each of the trailing locomotives informing them of their position within the consist. The identification of the lead locomotive can be used by controller 48 or the other controllers of the consist to determine the orientation of the minimum spanning tree. For example, when Lead is designated as the lead locomotive, controller 48 can determine that the locomotive consist order is Lead—Trail 1—Trail 2—Trail 3—Trail 4 as opposed to Trail 4—Trail 3—Trail 2—Trail 1—Lead (which would be the case had Trail 4 been designated as the lead locomotive).

In some embodiments, communication system 44 provides robust locomotive consist order determination by having each controller of the consist perform steps 310, 320, 330, and 340. The locomotive consist order determined by each controller can then be compared to determine if there are any inaccuracies. Such a robust system can mitigate the risk that one controller of the consist is non-operational or malfunctioning.

Once the locomotive consist order has been determined, controller 48 can communicate to the other controllers of the consist the position of their respective locomotives (step 350). The controllers of the consist can use the position of their associated locomotives to control locomotive operations, consistent with the embodiments disclosed herein.

Several advantages over the prior art may be associated with the disclosed system for determining locomotive position in a consist. The disclosed system for determining locomotive position may provide greater accuracy than conventional systems because it utilizes measurements collected from multiple locomotives within the consist. For example, the disclosed system for determining locomotive position in a consist can minimize error due to the orientation of locomotives in the consist (e.g., whether the locomotive is forward-facing or rear-facing) and can minimizes error due to varying response rates of the computer systems of locomotives.

It will be apparent to those skilled in the art that various modifications and variations can be made to the system for determining locomotive position in a consist. Other embodiments will be apparent to those skilled in the art from consideration of the specification and practice of the disclosed system for determining locomotive position in a consist. It is intended that the specification and examples be considered as exemplary only, with a true scope being indicated by the following claims and their equivalents.

What is claimed is:

1. A system for determining locomotive position in a consist, the consist including a first locomotive, a second locomotive, and one or more additional locomotives, and the system comprising:

a processor configured to:

determine first measurements taken starting from the first locomotive, wherein the first measurements are determined based on a ping measurement and capable of quantifying distances between the first locomotive and the second locomotive and the first locomotive and the one or more additional locomotives;

determine second measurements taken starting from the second locomotive, wherein the second measurements are determined based on a ping measurement and capable of quantifying distances between the second locomotive and the first locomotive and the second locomotive and the one or more additional locomotives;

combine the first measurements and the second measurements into a combined data set; and determine a locomotive consist order based on the combined data set.

2. The system of claim wherein combining the first measurements and the second measurements into a combined data set includes sorting the first measurements and the second measurements of the combined data set in ascending order.

3. The system of claim 2, wherein determining the locomotive consist order includes determining a minimum spanning tree for the combined data set.

4. The system of claim 3, wherein determining the minimum spanning tree includes applying Prim's Algorithm to the combined data set.

5. The system of claim 3, wherein the minimum spanning tree is an ordered list that defines the locomotive consist order.

6. The system of claim 1, wherein determining the second measurements includes receiving the second data set from the second locomotive.

7. The system of claim 1, wherein at least one of the first measurements and the second measurements includes distance measurements.

8. The system of claim 1, wherein at least one of the first measurements and the second measurements includes data transmission measurements.

9. The system of claim 1, wherein at least one of the first measurements and the second measurements includes signal strength measurements.

10. The system of claim 1, wherein at least one of the first measurements and the second measurements includes data rate measurements.

11. A locomotive consist comprising:

a plurality of intra-consist electrical cables;

a lead locomotive, the lead locomotive including a lead processor capable of communication via the intra-consist electrical cables;

a plurality of trail locomotives each including a trail processor capable of communication via the intra-consist electrical cables, wherein each trail processor is configured to:

determine a trail locomotive data set, the trail locomotive data set including measurements taken starting from the trail processor's trail locomotive, the measurements based on at least one ping measurement and capable of quantifying distances between the trail processor's trail locomotive and the lead locomotive and the trail processor's trail locomotive and the other trail locomotives of the locomotive consist, and communicate the determined measurements to the lead locomotive;

wherein the lead processor is configured to:

determine a lead locomotive data set, the lead locomotive data set including measurements taken starting from the lead processor's lead locomotive the measurements based on at least one ping measurement and capable of quantifying distances between the lead locomotive and each of the plurality of trail locomotives;

receive one or more trail locomotive data sets from the plurality of trail locomotives;

combine the measurements of the lead locomotive data set and the measurements of the received one or more trail locomotive data sets into a combined data set;

sort the measurements of the combined data set in ascending order;

determine a minimum spanning tree for he combined data set by treating the sorted measurements of the combined data set as edge weights for an undirected graph and applying Prim's Algorithm to the sorted measurements; and, determine a locomotive consist order based on the determined minimum spanning tree.

12. A system for determining locomotive position in a consist, the consist including a first locomotive, a second locomotive, and one or more additional locomotives, and the system comprising:

a processor configured to:

determine first measurements taken starting from the first locomotive, wherein the first measurements are determined based on a ping measurement and capable of quantifying distances between the first locomotive and the second locomotive and the first locomotive and the one or more additional locomotives;

determine second measurements taken starting from the second locomotive, wherein the second measurements are determined based on a ping measurement and capable of quantifying distances between the second locomotive and the first locomotive and the second locomotive and the one or ore additional locomotives;

combine the first measurements and the e second measurements into a combined data set; and determine a minimum spanning tree for the combined data set.

13. The system of claim 12, wherein determining the minimum spanning tree includes applying Prim's Algorithm to the combined data set.

14. The system of claim 12, wherein the minimum spanning tree is an ordered list that defines the locomotive consist order.

15. The system of claim 12, wherein determining the second measurements includes receiving the second data set from the second locomotive.

16. The system of claim 12, wherein at least one of the first measurements and the second measurements includes distance measurements.

17. The system of claim 12, wherein at least one of the first measurements and the second measurements includes data transmission measurements.

18. The system of claim 12, wherein at least one of the first measurements and the second measurements includes signal strength measurements.

19. The system of claim 12, wherein at least one of the first measurements and the second measurements includes data rate measurements.

20. The system of claim 12, wherein combining the first measurements and the second measurements into a combined data set includes sorting the first measurements and the second measurements of the combined data set in ascending order.

* * * * *